US005871096A

United States Patent [19]

Yakich

[11] Patent Number: 5,871,096

[45] Date of Patent: Feb. 16, 1999

[54] CONCEALED PROMOTIONAL MESSAGE FLEXIBLE PACKAGING AND METHOD OF MAKING SAME

[75] Inventor: Walter J. Yakich, Oak Creek, Wis.

[73] Assignee: Seville Flexpack Corporation, Oak Creek, Wis.

[21] Appl. No.: 947,040

[22] Filed: Oct. 8, 1997

[51] Int. Cl.[6] ..... B65D 30/08

[52] U.S. Cl. ..... 206/459.5; 383/116

[58] Field of Search ..... 206/457, 459.5; 383/40, 111, 116, 109

[56] References Cited

U.S. PATENT DOCUMENTS 4,033,611 7/1977 Johnsen .
4,705,301 11/1987 Dojel .
5,009,518 4/1991 Faltynek ..... 383/111
5,076,613 12/1991 Kovacs .
5,127,743 7/1992 Miller et al. .
5,286,062 2/1994 Greenwood et al. .

FOREIGN PATENT DOCUMENTS 2085308 4/1982 United Kingdom .

*Primary Examiner*—Jacob K. Ackun
*Attorney, Agent, or Firm*—Ryan Kromholz & Manion, S.C.

[57] ABSTRACT

A multiply promotional package and method of making same, wherein the package comprises an outer layer, an intermediate layer and an inner layer joined at least at there edges to enclose the package. Either of the oppositely disposed surfaces of the outer layer may contain a defined masking or message concealing area. A second masking area is provided in register with the first masking area. The masking areas provide a means of concealing a promotional message or indicia from the exterior of the package, until such time that the package and its contents have been purchased.

7 Claims, 2 Drawing Sheets

CONCEALED PROMOTIONAL MESSAGE FLEXIBLE PACKAGING AND METHOD OF MAKING SAME

BACKGROUND OF THE INVENTION

The present invention relates to promotional packaging, and more particularly to a package that includes a multi-ply wall containing a normally concealed, consumer accessible, promotional message or indicia located between two of the plies, and a method of manufacturing the package.

It is common practice to distribute promotional materials, such as game pieces, tickets, coupons and temporarily concealed printing in connection with sale of packaged foods and other commercial products. In the past, various attempts have been made to include promotional devices when distributing products at the point of purchase. Both the inclusion of separate pieces and of certain printing procedures have been used previously. In particular, where packaged foods are concerned, it is costly to provide separate game or other promotional pieces. Extra precaution must be taken to mount separate pieces exteriorly or between layers of packaging films, or to separately wrap the pieces when they are co-packaged with food, such as cereal, in order to prevent possible food contamination.

There have also been past attempts to print a hidden message directly on the package. In general, these attempts have proven to be ineffective. Most previous packaging materials were not conducive to having printing placed thereon, other than that relating to the standard package label. In particular, where games are involved, it becomes important that certain printing be hidden from view until after a sale of the product and opening of the packaging. This requires the printing of readable material or indicia on the inside of the packaging plies or laminates. Heretofore, this practice was difficult and relatively expensive.

Other methods for distributing promotional pieces have included gluing or otherwise affixing a gamepiece to the outside of the package, or to maintain the product and the promotional piece as separate entities to be distributed by a supermarket cashier at the point of sale. It will be apparent that these methods not only create opportunities for extensive abuse through intermediate handling of the gamepiece, but also effectively remove control of the particular promotion from the producer of the product.

Therefore, there exists a need for a package having a built-in promotional message which is simple to produce, such as by printing technique, which is cost effective, and which may be concealed until the package has been opened after sale.

There also exists a need for a package having a promotional message, which prevents contamination of the message by the packaged product, as well as contamination of the product.

There also exists a need for a package having a promotional message, which is not susceptible to tampering, and which can only be accessed after the package has been sold and destroyed.

According to the present invention, the foregoing advantages are attained by providing a novel package for receiving a comestible or other product along with a concealed message hidden from view, until such time that the package has been opened by an ultimate consumer. A novel method of fabricating the package is also taught herein.

One advantage of the invention is that it combines the use of a concealed message or indicia and a visible message or indicia. The concealed message or indicia acts as a game piece or other promotional device. The visible message or indicia acts to advertise a possible prize or otherwise entice consumers to purchase the product.

A wall of the novel package comprises at least two plies, an outer ply and a second intermediate ply. Preferably a third inner ply is added. Because the plies may be transparent, a variety of printing and masking combinations can be used to create and hide the concealed message. Preferably the concealed message is applied, by printing or otherwise, to either surface of the intermediate ply or the interior surface of the outer ply. A masking material is provided to hide the concealed message from exterior or interior view. The exact placement of the masking material depends upon the placement of the concealed message. For example, should the concealed message be printed on the exterior surface of the intermediate ply, the masking material can be applied to either the exterior or interior surfaces of the outer ply. Of course, other printing and masking combinations are also available depending on whether an opaque or transparent material is used.

A masking material may also be provided, by printing or otherwise, to hide the message when viewed from the wall's interior. For example, should the concealed message be printed on the interior surface of the intermediate ply (assuming a transparent material is used), the masking or concealing material can also be applied to the interior surface of the intermediate ply. This conceals the message when viewed from the wall's interior, yet leaves the message visible through the transparent ply when viewed from the intermediate ply's exterior.

The visible message may be printed on either the inner or outer surface of the outer ply, or the outer surface of the intermediate ply. If printed on the inside surface of the outer ply, the message would be printed in reverse, so that it would be readable from the exterior of the package. A masking material is also provided, by printing or otherwise, on the outer ply so as to hide the concealed message but not obscure the visible message. For example, should the visible message be printed on the interior surface of the outer ply (assuming a transparent material is used), a masking material is also applied to the interior surface of the outer ply. The masking material will cover the message when viewed from the wall's interior, yet leave the message visible when viewed through the transparent ply from the wall's exterior.

Although any of the above outlined techniques may be used within the province of this invention, the preferred procedure for fabricating the novel package utilizes, with minimal or no modification, known laminating and printing techniques. An alternate printing and masking technique involves applying the masking material to the exterior surface of the outer ply. Then, if desired, the visible message is printed on the masking area. This is the package surface that is usually seen by a prospective purchaser. A concealed message to be normally hidden from view by the masked area is then imprinted on the interior surface of the outer ply. The message, for instance, may inform the purchaser that he or she has won a contest prize. In this embodiment, the masking material will hide the concealed message even if the concealed message is printed on the interior surface of the outer ply. Additional combinations of printing and masking among the two plies will be apparent to those skilled in the art.

In accordance with another aspect of the invention, the outer and intermediate plies are not adhered to one another by an adhesive layer in an area surrounding the concealed message, thereby creating a non-adhering surface area wherein the outer and intermediate plies are not cojoined. Consequently, once the package is opened and cut along the periphery of this non-adhering surface area, the plies can be separated to reveal the concealed message. The adhesive layer is preferably applied to the outer facing area of the intermediate ply. If a third inner ply is used, an adhesive layer is preferably applied to the interior surface of the intermediate ply.

A further advantage of the invention is that the masking area need only be large enough to cover the concealed message. Thus, portions of the package can remain transparent so long as the concealed message is masked from both the wall's exterior and interior surfaces as described above.

A further advantage of the invention is that the outer and intermediate plies may be adhered over the entire area of the package wall, except the non-adhering surface area containing the concealed message, or adherence may be restricted to portions around the non-adhering surface area's periphery, thus ensuring that a prospective purchaser can not prematurely separate the plies to determine which package contains a winning message.

The concealed message contemplates many promotional devices such as, but not limited to:

- Message informing consumers that they have won a grand prize, or that they have won a secondary prize.
- Message informing consumers that they have lost, but to try again.
- Message informing consumers that they are eligible for a free product for a certain time span.
- Message informing consumers that they have a portion of the winning phrase or indicia, and must match it with the balance of the phrase or indicia by purchasing additional product.
- Message showing a diagram of a portion of the grand prize; for example an automobile. To win the automobile, they must complete the illustration of the automobile.

All messages are aimed at increasing the sale of the product being packaged, or by cross-referencing the sale of other products offered by the same supplier.

The invention further anticipates a novel method of fabricating a package containing a readable promotional message or indicia. The method contemplates the use of conventional printing, web handling and adhesive application equipment, as schematically presented in FIG. 6.

BRIEF DESCRIPTION OF THE DRAWINGS

For a better understanding of the invention as well as other objects and features thereof, reference is made to the following description which is to be read in conjunction with the accompanying drawings wherein.

DETAILED DESCRIPTION OF THE DRAWINGS

Figure 1:
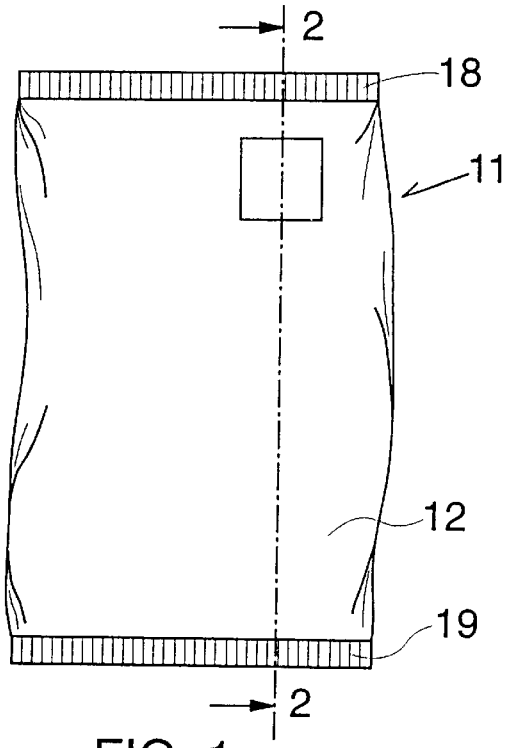
FIG. 1 is a front elevational view of the front wall of a sealed and pre-opened packageof the present invention.
Figure 4:
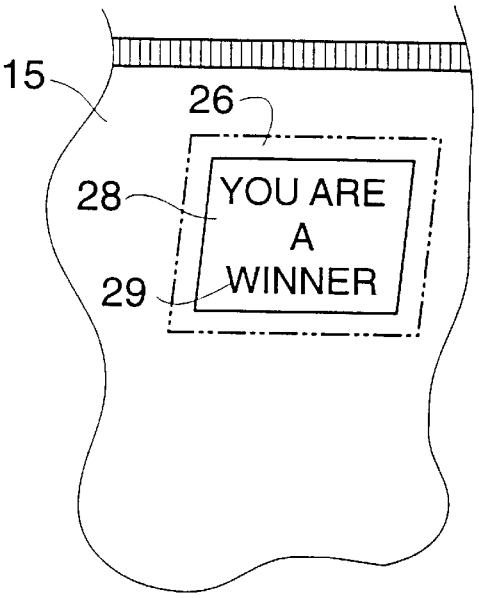
FIG. 4 is a fragmentary view of a portion of the intermediate ply of the threeply package embodiment of FIG. 2, and particularly illustrating the novel placement of a promotional message thereon.

With reference to the view of FIG. 1, it will be observed that the invention is preferably used in conjunction with a package 11 adopted for use in connection with promotional activities. The package 11 is of generally conventional three-ply or layer construction as disclosed in FIGS. 2 and 4.

Figure 2:
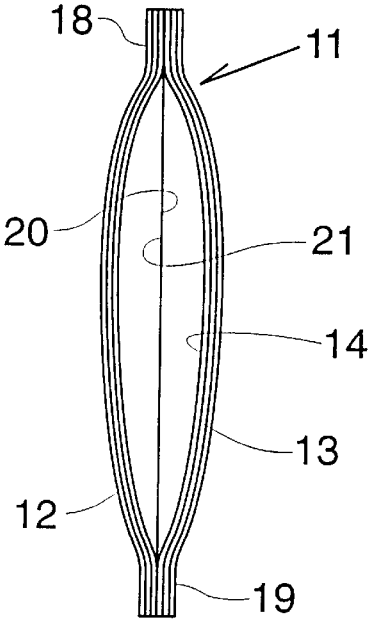
FIG. 2 a cross-sectional view taken along lines 2—2 of FIG. 1 showing a three-ply package construction, with individual plies and an adhesive layer being exaggerated for clarity.
Figure 3:
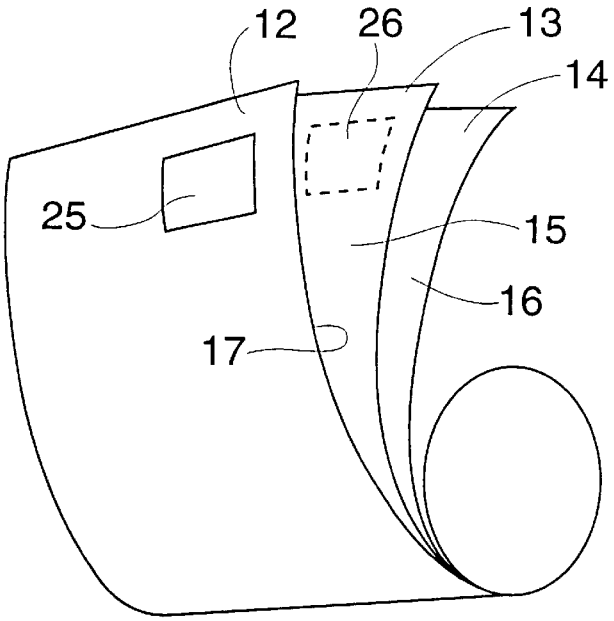
FIG. 3 is a perspective view depicting cooperating layers or plies forming the front wall of the package of this invention.

It is preferred to use a three-ply, laminated construction, wherein the package 11 may include an outer ply 12, an intermediate ply 13 and an inner ply 14 (See FIGS. 2 and 3). An adhesive layer is applied to seal the outer ply 12 and the intermediate ply 13 together in an area to be later described. The package 11 is conventionally provided with a top edge 18, a bottom edge 19, a first side edge 20, and a second side edge 21. To form the package the first side edge 20 and the second side edge 21 are brought together and sealed. To complete the enclosure, the upper and lower edges of each of the plies 12, 13 and 14 are sealed in the usual and conventional course after receiving the contents to be packaged. It is to be noted that the inner ply 14 is preferably provided, as is often required for added protection of packaged comestibles. If desired, it may be eliminated when packaging non-comestibles.

As will be apparent from the views of FIGS. 1–4, inclusive, the invention comprises printing, or otherwise marking, a visable promotional message or indicia, which is normally concealed from viewing any side of the package 11. This is accomplished by defining a promotional message area; such as the rectangular area 25 depicted on the outer ply 12 (See FIG. 3). The area 25 is shown here as a rectangle, but any suitable geometric configuration may be used. The area 25 is opaque in order to conceal or obscure the promotional message, such as a prizewinner notation, until after a sale has been made and the package has been opened. It will become apparent from this description that the entire outer ply 12 may be of opaque material, or an enlarged area may be printed thereon using an opaque ink, and still remain within the province of this invention. The masking or concealing area 25 may be printed on either the front or the reverse side of the outer ply 12. If desired, an additional message (not shown) may be printed within the surface area 25 to act as a "teaser," indicating the possibility of a "prizewinner" message existing within the packaging plies 12, 13 or 14.

FIG. 2 illustrates the assembled and printed multi-layer package 11 of the present invention including a top edge 18, a bottom edge 19, a first side edge 20 and a second side edge 21. To form a bag, the first side edge 20 and the second side edge 21 are brought together and sealed. To complete the enclosure, the two sealed halves of the top edge 18 are preferable crimped and sealed, as are the halves forming the bottom edge 19.

Figure 5:
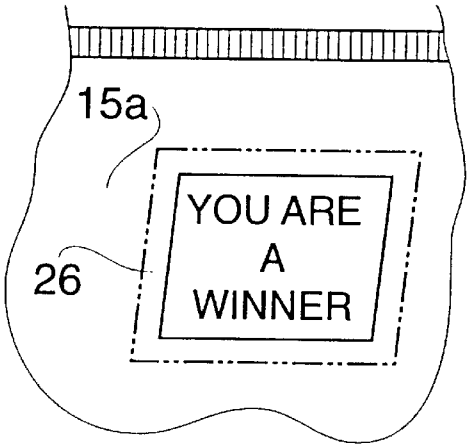
FIG. 5 is a fragmentary view of a portion of another package embodiment indicating the application of an adhesive frame-like are arranged to define a non-adhering surface area.

As shown in FIGS. 2 and 3, an adhesive coating 15 may be applied to either the outer facing surface 16 of the intermediate layer 13 or the inner facing surface 17 of the outer ply or laminate 12. As illustrated herein, the adhesive layer 15 defines a non-adhering area 26. The adhesive area covers a substantial portion of the surface 16, and may, in fact cover the entire surface 16, or may be distributed in a frame-like outline arranged to define the non-adhering area 26, as shown in FIG. 5. Either adaptation of adhesive 15 or 15*a* will insure that the area 26 is not exposed, should the prospective purchaser attempt to separate the layers 12 and 13 to provide a premature "peek" at the message to be concealed. Preferably, the area 26 is provided with a second opaque masking area 28 arranged to receive a printed concealed message or indicia 29, such as "You Are The Winner."

Figure 6:
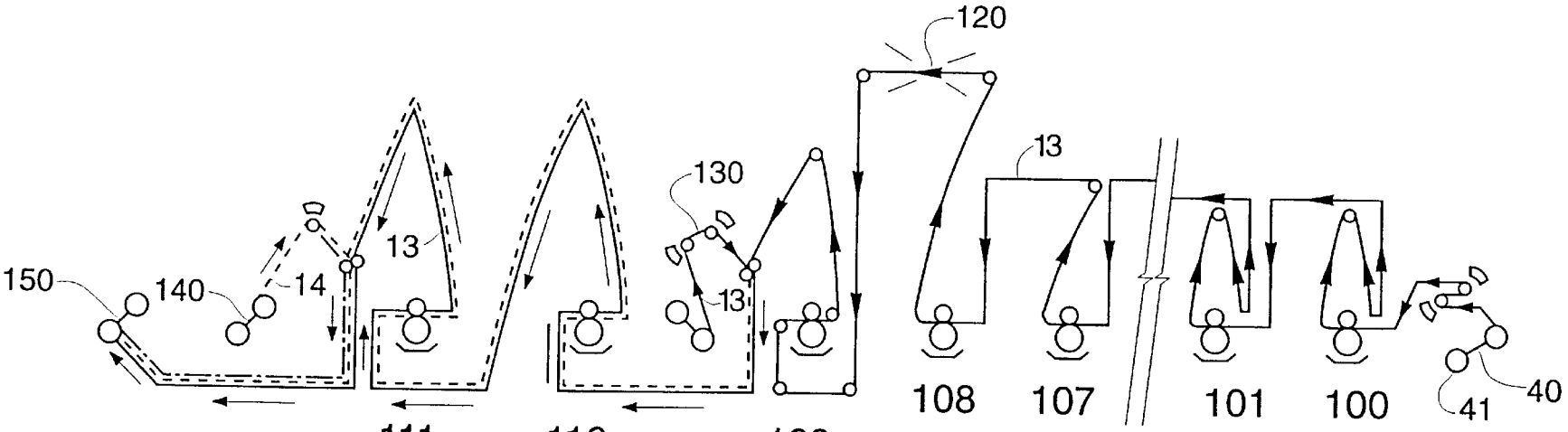
FIG. 6 is schematic diagram of the preferred process for making the package of this invention.

With reference to FIG. 6, it will be observed that the method of manufacturing a multi-ply promotional package may include multiple steps, or operational stations, arranged to apply ink, adhesive, folding and other necessary procedures utilizing a continuous single web.

The web 40 is unwound from a supply roll 41 and is fed to a first ink station 100 for printing the opaque printed area 25, and if desired, other necessary conventional labeling or sales messages and indicia on the outer ply 12 portion of the continuous web 40. The ink stations 100–107, inclusive, imprint primary design inks that act to hide the concealed promotional message, such as, "You Are the Winner."

At station 108, the portion of the web 40, which will comprise the outer layer or ply 12, will have the desired message or copy 25 printed thereon. At station 109, following passage through a turn-around bar 120, adhesive is applied, but not to the area designating the promotional message 25, such as "winner" or "loser."

The outer ply 12 is glued to the intermediate ply 13, and the cut and rewound at station 130, with the remaining web 40 continuing to station 110, where the pre-printed masking area 26 is applied. The web 40 then continues to station 111 where an all-over adhesive film is applied and the inner ply 14 is adhered thereto, having been unwound from a feed roll 140. All three plies 12,13 and 14 are assembled and sealed together at station 150, to provide the finished package as shown in FIG. 2.

While the invention has been described in detail with particular reference to the preferred embodiments thereof, it will be understood that variations and modifications can be effected within the spirit and scope of the invention as previously described and as defined in the claims.

What is claimed is:

1. A sealable package having an exterior and an interior defined by at least one wall of multi-ply material, said wall comprising:

an outer ply having an exterior surface and an interior surface;

a second ply including a first surface facing the interior surface of said outer ply, and a second interiorily facing surface;

the interior surface of said outer ply and the first surface of said second ply conjoined by an adhesive layer;

said adhesive layer surrounding and defining a non-adhering surface area wherein said interior surface of said outer ply and said first surface of said second ply are not conjoined;

said non-adhering surface area including a readable message and a means for concealing said readable message when viewed from the exterior of said sealable package.

2. The sealable package of claim 1, wherein a third ply is provided to protect comestibles when contained within the sealable package.

3. The sealable package of claim 1, wherein said means of concealing comprises coating at least a portion of at least one surface of said outer ply with a masking material;

said portion at least encompassing said non-adhering surface area.

4. The sealable package of claim 3, wherein said masking material is applied to at least one surface of said outer layer and at least one surface of said second layer.

5. The sealable package of claim 1, wherein said means for concealing comprises coating at least a portion of at least one surface of said second ply with a masking material;

said portion at least encompassing said non-adhering surface area.

6. The sealable package of claim 1, wherein a means for concealing said readable message when viewed from the interior of said sealable package comprises coating at least a portion of at least one surface of said second ply with a masking material;

said portion at least encompassing said non-adhering surface area.

7. The sealable package of claim 1, wherein said readable message is an indicia.

* * * * *